United States Patent [19]

Tamagawa et al.

[11] Patent Number: 4,791,093

[45] Date of Patent: Dec. 13, 1988

[54] HEAT-SENSITIVE RECORDING SHEET

[75] Inventors: Shigehisa Tamagawa; Kazuyuki Koike; Tetsuro Fuchizawa, all of Shizuoka, Japan

[73] Assignee: Fuji Photo Film Co., Ltd., Kanagawa, Japan

[21] Appl. No.: 918,442

[22] Filed: Oct. 14, 1986

[30] Foreign Application Priority Data

Oct. 15, 1985 [JP] Japan ..... 60-229543

[51] Int. Cl.[4] ..... B41M 5/18

[52] U.S. Cl. ..... 503/200; 427/152; 428/211; 428/342; 428/409; 428/537.5; 428/913; 503/226

[58] Field of Search ..... 346/200, 226; 428/211, 428/537.5, 334, 335, 342, 409, 913, 914; 503/200, 226; 427/150–152

[56] References Cited

U.S. PATENT DOCUMENTS 4,333,984 6/1982 Igarashi et al. ..... 428/537.5

FOREIGN PATENT DOCUMENTS 2111699A 7/1983 United Kingdom ..... 346/226
2111701A 7/1983 United Kingdom ..... 346/226
2112155 7/1983 United Kingdom ..... 503/200
2112154 7/1983 United Kingdom ..... 503/200
2122763 1/1984 United Kingdom ..... 503/200

*Primary Examiner*—Bruce H. Hess
*Attorney, Agent, or Firm*—Sughrue, Mion, Zinn, Macpeak & Seas

[57] ABSTRACT

A heat-sensitive recording sheet comprising a paper support having provided thereon a heat-sensitive coupling layer, said paper support having an intermediate layer containing at least one white pigment disposed on a base paper comprising a mixture of synthetic pulp and natural pulp. The heat-sensitive recording sheet has increased contact with a thermal head, a high recorded density and good dot reproducibility.

12 Claims, No Drawings

HEAT-SENSITIVE RECORDING SHEET

FIELD OF THE INVENTION

The present invention relates to heat-sensitive recording sheet for recording with a thermal head or a thermal pen, and more particularly, to heat-sensitive recording sheet which has a heat-sensitive coupling layer that does not stick to a thermal head which does not cause piling or heat fused substances in the thermal head, which reproduces dots well and which can provide clear, deep-density recording even in high-speed recording.

BACKGROUND OF THE INVENTION

In recent years, facsimiles, printers, and the like have been developed markedly, and in particular, a heat-sensitive recording method comprising using a thermal head to record on a heat-sensitive recording sheet comprising a colorless dye such as crystal violet lactone or the like and a phenol compound as disclosed in U.S. Pat. No. 3,539,375 and the like has been widely adopted.

The heat-sensitive recording method has many advantages in that the recording sheet is for primary coupling (requiring no development), the recording apparatus can be simplified, the recording sheet and recording apparatus are inexpensive, and the recording method is of the non-impact type and is not noisy, so that it has established its position as a low speed recording method. However, a large defect of the heat-sensitive recording method is that its recording speed is lower than that of the other recording methods such as electrostatic recording and the like, so that, prior to the present invention, the heat-sensitive recording method was not adopted for high-speed recording.

The greatest reason why high-speed recording could not be conducted using the heat-sensitive recording method was that heat conduction was not sufficiently carried out between a thermal head and the heat-sensitive recording sheet brought into contact with the thermal head and a sufficient recording density could not be obtained.

A thermal head having dot-like electric resistance heating elements generates heat according to recording signals which thereby causes melting and coloring of the heat-sensitive coupling layer which is contact in with the thermal. To obtain clear, deep-density recording, it is necessary that dot reproducibility is good, that is, the thermal head is contacted with the heat-sensitive coupling layer as fast as possible to carry out heat conduction efficiently, and dots colored completely and corresponding to the shape of dot heating elements in the thermal head are formed, completely corresponding to the high-speed recording signals, on the heat-sensitive coupling layer. Prior to the present invention, however, only several percent of heat quantity generated in the thermal head is conducted to the heat-sensitive coupling layer and the efficiency of heat conduction is very low.

Some methods of improving the evenness of the heat-sensitive coupling layer to contact a thermal head to the heat-sensitive coupling layer as fast as possible have been proposed.

In Japanese Patent Publication No. 20142/77, the surface treatment of heat-sensitive coupling layer having a Beck smoothness of 200–1000 sec is disclosed, and in Japanese Patent Application (OPI) No. 115255/79 (the term "OPI" as used herein means an "unexamined published application), it is disclosed that a heat-sensitive coupling layer of Beck smoothness of 200–1000 sec can correspond only to a heat pulse of about 5–6 milisecond and that the surface of a heat-sensitive coupling layer needs to be surface-treated to a Beck smoothness of 1100 sec or more to carry out high-speed recording with a heat pulse of 1 milisecond or less. When the Beck smoothness is 1100 sec or more in the heat-sensitive coupling layer, a colored fog is formed by pressure, so that the smoothness of base paper to be used is maintained at a Beck smoothness of 500 to 800 sec in advance to prevent formation of colored fog. In Japanese Patent Application (OPI) No. 156086/76, it is mentioned that the surface roughness, Ra, of a heat-sensitive coupling layer should be 1.2 microns or less and the glossiness of the surface of the layer 25% or less. (The glossiness means specular glossiness measured at the angle of incidence of 75° as describedin JIS-P-8149.)

In the conventional techniques for improvement in the above-mentioned evenness, the smoothness of heat-sensitive coupling layer has been improved only by calendering treatment with a super calender, a machine calender, a gloss calender, or the like. The calendering treatment is applied only to the base paper, to the base paper and heat-sensitive recording sheet, or the heat-sensitive recording sheet.

Sticking is a phenomenon of the thermal head sticking to the heat-sensitive coupling layer and as a resulting of sticking, a release noise is generated or dot reproducibility is reduced. Piling is a phenomenon of the heat fused material of heat-sensitive coupling layer piling up in the thermal head and as a result of piling, a recorded density and dot reproducibility are both reduced. Any of the two phenomena hinders stable recording.

As a heat-sensitive recording sheet is improved in its smoothness and in its recorded density, the sticking and piling phenomena of the heat-sensitive recording sheet are increased, so that actually, the smoothness is restrained to an appropriate level so that the recorded density is ballanced with the sticking and piling phenomena. Even if the smoothness of heat-sensitive recording sheet of the conventional techniques is set at any possible level, the heat-sensitive recording sheet is not practical for high-speed recording in respect of recorded density or recording stability.

Further, another defect of heat-sensitive recording sheet caused by the calendering treatment is that a colored fog is formed by pressure and the density of textured portion of the recording sheet is increased. In contrast, when base paper is calendering-treated, so-called depressed areas, or bonds wrinkles caused by uneven weighing are formed, and the treatment of such defect is limitative.

As mentioned above, improvement in smoothness of heaat-sensitive coupling layer and in the recorded density of the recording sheet by the calendering treatment is necessarily limited and satisfactory heat-sensitive recording sheet for high-speed recording has not been obtained by the calendering treatment.

SUMMARY OF THE INVENTION

An object of the invention is to provide a heat-sensitive recording sheet which does not have the above-mentioned defects, that is, a heat-sensitive recording sheet having good dot reproducibility and high recorded density.

The inventors have devoted themselves on studies on alleviation of these defects and as a result, have found that a heat-sensitive recording sheet having the above-mentioned desired characteristics can be obtained by a heat-sensitive recording sheet comprising a support having a white pigment-containing intermediate layer disposed on a base paper containing a mixture of synthetic pulp and natural pulp.

DETAILED DESCRIPTION OF THE INVENTION

As the synthetic pulp for use in the invention, there may be mentioned pulp produced by extruding a thermoplastic resin and, after that, splitting the extruded film by various methods as disclosed in Japanese Petent Pulbication Nos. 9651/60, 5212/64, 28125/65, 6215/66, and 9044/65, and pulp produced by polymerizing an olefin into a fibrous substance under a shearing force in the presence of a Ziegler catalyst as disclosed in BE-739251.

As the polyolefin, polyethylene or polypropylene are preferred. The fiber length is preferably 0.5–1.5 mm.

The preferred content of the synthetic pulp in a mixture of the synthetic pulp and the natural pulp is 10–70 wt%, and the further preferred content of the synthetic pulp is 20–50 wt%, When the content is less than 10 wt%, the effect to the synthetic pulp used is small and when the content exceeds 70 wt%, the tensile strength is lowered so much that such a large amount of synthetic pulp cannot be used.

As the natural pulp for use in the invention, wood pulp such as broadleaf tree pulp, coniferous tree pulp, or the like can be used but the broadleaf tree pulp consisting of short fiber easily provides smoothness of paper and, therefore, is preferred.

As a mixing method for the wood pulp and the synthetic pulp, a method for beating only wood pulp before mixing synthetic pulp to the wood pulp may be used or a method for mixing the wood pulp and the synthetic pulp before beating the mixture may be used. Either way, it is preferred that a beating degree after mixing is 200–400 cc (Canadican Standard Freeness).

Further to the pulp mixture, at least one of rosin, paraffin wax, a higher fatty acid salt, an alkenyl succinic acid salt, a fatty acid anhydride, a styrene maleic anhydride copolymer, an alkylketene dimer or an epoxidated fatty acid amide may be added as a sizing agent; one or more reaction product of maleic anhydride copolymer with polyalkylene polyamine or quaternary ammonium salt of higher fatty acid may be added as a softening agent; at least one of polyacrylamide, starch, polyvinyl alcohol, melamine/formaldehyde condensate or gelatin may be added as a reinforcing agent; and at least one of alum earth or polyamide polyamine epichlorohydrin may be added as a fixing agent. In addition, one or more of a dye, a fluorescent dye, an antistatic agent, and the like can be added to the pulp mixture, as required.

The preferred density of a base paper having synthetic pulp mixed in it is 0.8–1.0 g/cm$^3$. If the density is less than 0.8 g/cm$^3$, smoothness of base paper is low and the effect of the invention is reduced. If the density exceeds 1.0 g/cm$^3$, blackening caused by the collapse of the synthetic pulp is often formed, so that such a density is not preferred.

As a treatment for the obtaining the desired density, there may be mentioned machine calendering treatment, super calendering treatment, gloss calendering treatment, and the like but, of these, the super calendering treatment is specially preferred. The moisture of base paper in a calendering treatment is 5–12%, preferably 6–9%. Further, it is preferred that the internal bonding force (as prescribed in Zappi RC-308) of base paper is 0.5–1.5 kg.cm. If the force is less than 0.5 kg.cm, a problem such as paper break or the like arises, and if the force exceeds 1.5 kg.cm, smoothness of paper is low and high recorded density cannot be obtained. The desired internal force can be obtained by controlling a mixing ratio of the synthetic and/or the natural pulp, a beating degree, sizing agents, reinforcing agents, softening agents, fixing agents and the like.

Beck smoothness of the base paper used in the invention preferably ranges from 100–800 sec, more preferably 200–600 sec. The thickness of the base paper is preferably 30 to 150 $\mu$m.

As white pigments for use in the intermediate layer in the invention, there may mentioned inorganic pigments such as kaolin, calcined kaolin, talc, calcium carbonate, barium sulfate, titanium oxide and the like and organic pigments such as urea formaldehyde resin, acrylic resin, polystyrene resin and the like. The oil absorption degree of the pigments is 10–150 cc/100 g, preferably 30–80 cc/100 g, more preferably 30–50 cc/100 g.

As the binder of the intermediate layer, a water soluble high molecular substance such as starch, carboxymethylcellulose, hydroxyethylcellulose, polyvinyl alcohol, polyacrylamide or the like, or an emulsion resin such as styrene butadiene rubber (SBR), methyl methacrylate butadiene rubber (MBR), stylene methylmethacrylate butadiene rubber (SMBR) styrene/acrylate copolymer, methylmethacrylate (MMA)/acrylate copolymer or the like is used. Further, an agent for imparting water resistance such as melamine/formaldehyde resin, urea/formaldehyde resin, polyamide polyurea, polyamide polyamine epichlorohydrin or the like can be added.

The coating weight of intermediate layer is 1–10 g/m$^2$, preferably 3–7 g/m$^2$. When the coating weight is less than 1 g/m$^2$, high recorded density cannot be obtained and a dispersion in coloring caused by blackening formed when the density of synthetic pulp-wood pulp mixed paper is increased cannot be prevented.

Next, a heat-sensitive coating solution for use in the invention will be described.

For the heat-sensitive coating solution, in general, a coupler and a developer are separately dispersed in each solution of water soluble high molecular substance by use of a means such as ball mill or the like. Pulverization of the coupler or developer can be attained by using balls of different diameters at an appropriate mixing ratio and further dispersing the coupler or developer for a sufficient time in the case where a ball mill is used as a means for pulverization. Besides a ball mill, it is also effective to use a model sand mill (trademark: Dayno Mill) or the like.

The thus obtained coupler dispersion and developer dispersion are mixed and, to the resulting mixed dispersion, one or more of inorganic pigments, waxes, a higher fatty acid amide and a metallic soap, may be added and further, one or more of an ultraviolet ray absorbing agent, an anti-oxidant, a latex-containing binder and the like may be added, as required. Thus, a heat-sensitive coating solution is produced. These additives may be added when the coupler or developer is dispersed.

The heat-sensitive coating solution is applied to a support so that, in general, the coating weight of the coupler becomes 0.2–1.0 g/cm$^2$. The coating weight of the developer is 0.2–3.0 g/m$^2$, preferably 0.5–2.0 g/m$^2$.

As the coupler for use in the invention, ones used in common pressure-sensitive sheets, common heat-sensitive sheets, and the like can be used, and the coupler for use in the invention is not specially limitated. As specific examples, there may be mentioned (1) triarymethane-containing compounds such as 3,3-bis(p-dimethylaminophenyl)-6-dimethylaminophthalide (crystal violet lactone), 3-(p-dimethylaminophenyl)-3-(1,2-dimethylindole-3-yl)phthalide, 3-(p-dimethylaminophenyl)-3-(2-phenylindole-3-yl)phthalide, 3,3-bis(p-ethylcarbazole-3-yl)-B 5-dimethylaminophthalide, 3,3-bis(2-phenylindole-3-yl)-5-dimethylaminophthalide and the like; (2) diphenylmethane-containing compounds such as 4,4-bis-dimethylaminobenzhydrin benzyl ether, N-halophenyl leucoaulamine, N-2,4,5-trichlorophenyl leucoaulamine and the like; (3) xanthene-containing compounds such as rhodamine B-anilinolactam, 3-diethylamino-7-dibenzylaminofluoran, 3-diethylamino-7-butylaminofluoran, 3-diethylamino-7-(2-chloroanilino)-fluoran, 3-diethylamino-6-methyl-7-anilinofluoran 3-piperidino-6-methyl-7-anilinofluoran, 3-ethyltolylamino-6-methyl-7-anilinofluoran, 3-cyclohexylmethylamino-6-methyl-7-anilinofluoran, 3-diethylamino-6-chloro-7-(β-ethoxyethyl)aminofluoran, 3-diethylamino-6-chloro-7-(γ-chloropropyl)aminofluoran, 3-diethylamino-6-chloro-7-anilinofluoran, 3-N-hexyl-N-methylamino-6-methyl-7-anilinofluoran, 3-diethylamino-7-phenylfluoran and the like; (4) thiazine-containing compounds such as benzoyl leucomethylene blue, p-nitrobenzoyl leucomethylene blue and the like; and (5) spiro-containing compounds such as 3-methylspiro-dinaphthopyran, 3-ethyl-spiro-dinaphthopyran, 3-benzyl-spiro-dinaphthopyran, 3-methylnaphtho-(3-methoxybenzo)-spiropyran and the like, and a mixture of these compounds. These are selected according to the use and desired characteristics of heat-sensitive recording paper.

As the developers for use in the invention, a phenols and an aromatic carboxylic acids are preferred and, in particular, bisphenols are preferred. As the specific example of phenols, there may be mentioned p-octylphenol, p-tert-butylphenol, p-phenylphenol, 2,2-bis(p-hydroxyphenyl)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, 2,2-bis(4-hydroxy-3,5-dichlorophenyl)propane and the like. As the specific example of aromatic carboxylic acids, there may be mentioned p-hydroxybenzoic acid, propyl p-hdroxybenzoate, butyl p-hydroxybenzoate, benzyl p-hydroxybenzoate, 3,5-di-α-methylbenzyl salicyclic acid and polyvalent metallic salts of the above-mentioned carboxylc acids.

To cause the developer to melt at a desired temperature to effect the coupling reaction, it is preferred to add the developer as an eutectic mixture of it with a low melting heat meltable substance or to add it in a state where a low melting compound is fused onto the surface of its particles.

As waxes, there may be mentioned paraffin wax, carnauba wax, microcrystalline wax, polyethylene wax, higher fatty acid amides such as staeric acid amide and ethylene bisstearamide, higher fatty acid esters and the like.

As the metallic soap, there may be mentioned polyvalent metallic soaps of higher fatty acids such as lead stearate, aluminum stearate, calcium stearate, zinc oleate and the like.

As inorganic pigments, thereby may be mentioned kaolin, calcined kaolin, talc, pagodite, keiselguhr, calcium carbonate, aluminum hydroxide, magnesium hydroxide, magnesium carbonate, titanium oxide, barium carbonate and the like.

It is preferred that these inorganic pigments have an oil absorption degree of 60 ml/100 g and over and an average particle diameter of 5 microns or less. It is preferred to mix the inorganic pigment having oil absorbing properties in the recordng layer in an amount of 5–50 wt% preferably 10–40 wt% based on the weight of recording layer.

The above additives are dispersed in a binder and the dispersion is applied to a support. The binder is, in general, a water soluble one, and as the binder, there may be mentioned polyvinyl alcohol, hydroxyethyl cellulose, hydroxypropyl cellulose, ethylene-maleic anhydride copolymer, styrene-maleic anhydride copolymer, isobutylene-maleic anhydride copolymer, polyacrylic acid, starch derivative, casein, gelatin and the like.

To impart water resistance to such a binder, an agent for imparting water resistance (for example, a gelling agnet or a crosslinking agent) or an emulsion of hydrophobic polymer (for example, styrene-butadiene rubber latex, acrylic resin emulsion or the like) can be added to the binder.

The binder is mixed in the recording layer in an amount of 10–30 wt% based on the weight of recording layer. Further, additives such as anti-foaming agents, fluorescent dyes, colored dyes and the like can be added to the heat-sensitive coating solution, as required.

For the coating solution for forming such a recording layer, a well-known coating method such as a blade coating method, an air knife coating method, a gravure coating method, a roll coating method, a spray coating method, a dip coating method, a bar coating method, an extrusion coating method or the like can be used.

A coating weight of the coating solution on a support is not limited. However, the dry coating weight is usually 3–5 g/m$^2$, preferably 4–10 g/m$^2$.

Examples of the present invention are presented below. The examples are illustrative and should not be considered as limiting the invention. All amounts, ratios, etc., are by weight, unless otherwise specified.

EXAMPLES

After wood pulp and synthetic pulp (polyethylene synthetic pulp, SWPE-400, produced by Mitsui Gerapack Co.) were mixed at a mixing ratio as shown in Table 1, the mixed pulp was beaten with a disk refiner until a freeness degree of 350 cc C.S.F. was obtained. Subsequently, to the beaten pulp, 5.0 wt% of talc, 1.0 wt% of rosin and 2.0 wt% of alum earth were added, based on the weight of dry pulp, and then a base paper having thickness of 56 microns and a density of 0.89 g/cm$^3$ and weighing 50 g/cm$^2$ was made with a long-net paper machine. The internal bonding force of the resulting base paper was as shown in Table 1. Subsequently, the base paper was coated with an intermediate layer having a composition as shown in Table 1 by an air knife coating method and, thus, a support per the invention was obtained. By a process similar to the above-mentioned process, a support containing no synthetic pulp and a support having no intermediate layer disposed on the base paper were produced as comparative examples.

A heat-sensitive coating solution was applied to the support of the example and of the comparative examples to obtain each heat-sensitive recording sheet. Heat-sensitive recording was made on the heat-sensitive recording sheet and the recorded density was measured. The results are shown in Table 2. The method used to prepare the heat-sensitive coating solution, the coating method for coating the solution, and the method for measuring the heat-sensitive recorded density will be described hereinafter.

| Symbol | Reproducibility of dot |
|---|---|
| A: | Good-suitable for practical use. |
| B: | It causes some troubles in practical use. |
| C: | Not suited for practical use. |

TABLE 1

| | Base paper | | Intermediate layer | | |
|---|---|---|---|---|---|
| Sample No. | Pulp | Internal bonding force | Composition | | Coating Weight |
| No. 1 (Invention) | LBKP 70% SWP 30% | 1.35 | Calcined kaolin<br>SBR latex | 100 parts<br>20 parts | 3 g/m$^2$ |
| No. 2 (Invention) | LBKP 60% SWP 40% | 1.18 | Calcined kaolin<br>SBR latex | | 4 g/m$^2$ |
| No. 3 (Invention) | " | " | Calcium carbonate<br>PVA<br>Starch | 100 parts<br>10 parts<br>5 parts | 7 |
| No. 4 (Invention) | LBKP 30% SWP 50%<br>NBKP 20% | 1.29 | Calcium carbonate<br>PVA<br>Starch | | 5 g/m$^2$ |
| No. 5 (Comparison) | LBKP 50% NBKP 50% | 2.98 | — | | — |
| No. 6 (Comparison) | NBKP 100% | 3.62 | — | | — |
| No. 7 (Comparison) | " | " | Calcium carbonate<br>PVA<br>Starch | 100 parts<br>10 parts<br>5 parts | 5 g/m$^2$ |
| No. 8 (Comparison) | NBKP 60% SWP 20%<br>LBKP 20% | 1.71 | — | | — |

Method for Preparing Heat-Sensitive Coating Solution 20 kg of crystal violet lactone was dispersed in an aqueous 10% solution of polyvinyl alcohol (having a saponification degree of 98% and a polymerization degree of 500) in a 300 l ball mill for 24 hours. Similarly, 20 kg of 2,2-bis(4-hydroxyphenyl)propane was dispersed in an aqueous 10% solution of polyvinyl alcohol in a 300 l ball mill for 24 hours. Then, both dispersions were mixed so that the mixing ratio of crystal violet lactone to 2,2-bis(4-hydroxyphenyl)propane was 1:5 in terms of a weight ratio and, subsequently, 5 kg of precipitated calcium carbonate was added to 20 kg of the resulting mixture and dispersed sufficiently. Thus, the heat-sensitive coating solution was obtained.

Coating Method of Heat-Sensitive Coating Solution

The coating solution was applied to the one side of base paper with an air knife coater at a coating weight as the solid matter of 6 g/m$^2$, the wet coated base paper was dried in a hot air at 50° C. and then the paper was treated on a machine calender.

Method for Measuring Heat-Sensitive Recording Density

Close coupling was carried out under conditions of a recording speed of 2 milliseconds per dot, of a recording density of 5 dots/mm in the principal scanning direction and of 6 dots/mm in the sub-scanning direction, and of thermal head energy of 50 milijoules/mm$^2$. The reflection density of the close coupling by use of light of 610 nm was measured for determining the recorded density.

The results were shown in Table 2. Reproducibility of dots as shown in Table 2 was evaluated by visual inspection and the results were represented by symbols as follows.

TABLE 2

| Sample No. | Recorded density | Reproducibility of dot |
|---|---|---|
| No. 1 (Invention) | 1.10 | A |
| No. 2 (Invention) | 1.19 | A |
| No. 3 (Invention) | 1.22 | A |
| No. 4 (Invention) | 1.16 | A |
| No. 5 (Comparison) | 0.80 | C |
| No. 6 (Comparison) | 0.76 | C |
| No. 7 (Comparison) | 0.96 | B |
| No. 8 (Comparison) | 0.89 | C (uneven coloring) |

From the results in Table 2, it can be seen that the heat-sensitive recording sheet of the invention has excellent characteristics, i.e., excellent recorded density and excellent dot reproducibility.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording sheet comprising a paper support having provided thereon a heat-sensitive coupling layer, said paper support having an intermediate layer containing at least one white pigment disposed on a base paper comprising a mixture of synthetic pulp and natural pulp, wherein said base paper has a density of 0.8 to 1.0 g/cm$^3$.

2. A heat-sensitive recording sheet as claimed in claim 1, wherein said base paper has an internal bonding force of 0.5 to 1.5 kg.cm.

3. A heat-sensitive recording sheet as claimed in claim 1, wherein said synthetic pulp is a polyolefin-containing synthetic pulp.

4. A heat-sensitive recording sheet as claimed in claim 3, wherein said polyolefin is selected from the group consisting of polyethylene or polypropylene.

5. A heat-sensitive recording sheet as claimed in claim 4, wherein said polyethylene or polypropylene has a fiber length of 0.5 to 1.5 mm.

6. A heat-sensitive recording sheet as claimed in claim 3, wherein said synthetic pulp is selected from the group consisting of pulp produced by extruding a thermoplastic resin and, after that, splitting the extruded film and pulp produced by polymerizing an olefin into a fibrous substance under a shearing force in the presence of a Ziegler catalyst and said natural pulp is wood pulp selected from the group consisting of broadleaf tree pulp and coniferous tree pulp.

7. A heat-sensitive recording sheet as claimed in claim 1, wherein said synthetic pulp is contained in an amount of 10 to 70 wt% of the mixture.

8. A heat-sensitive recording sheet as claimed in claim 1, wherein said white pigment is selected from the group consisting of kaolin, calcined kaolin, talc, calcium carbonate, barium sulfate, titanium oxide, urea formaldehyde resin, acrylic resin and polystyrene resin with an oil adsorption degree of from 10–150 cc/100 g.

9. A heat-sensitive recording sheet as claimed in claim 8, wherein said heat-sensitive coupling layer contains a coating solution comprising a coupler and a developer and the coating weight of the coupler and the developer is 0.2 to 1.0 g/m$^2$, 0.2 to 3.0 g/m$^2$, respectively.

10. A heat-sensitive recording sheet as claimed in claim 1, wherein said intermediate layer has a coating weight of 1–10 g/m$^2$.

11. A heat-sensitive recording sheet as claimed in claim 1, wherein said base paper has Beck smoothness of 100 to 800 sec.

12. A heat-sensitive recording sheet as claimed in claim 1, wherein said base paper has a thickness of 30 to 150 $\mu$m.

* * * * *